United States Patent [19]

Penney

[11] Patent Number: 4,861,356

[45] Date of Patent: Aug. 29, 1989

[54] CLOSE-SPACED ELECTROSTATIC PRECIPITATOR

[76] Inventor: Gaylord W. Penney, 216 Paris Rd., Pittsburgh, Pa. 15235

[21] Appl. No.: 36,130

[22] Filed: Apr. 3, 1987

Related U.S. Application Data

[63] Continuation of Ser. No. 735,566, May 17, 1985, abandoned.

[51] Int. Cl.[4] ..... B03C 3/00

[52] U.S. Cl. ..... 55/137; 53/138; 53/139; 53/117; 53/155; 55/154

[58] Field of Search ..... 55/105, 117, 120, 130, 55/137, 138, 143, 145, 154, 139

[56] References Cited

U.S. PATENT DOCUMENTS

| | | | |
|---|---|---|---|
| 2,142,128 | 1/1939 | Hoss et al. | 55/138 X |
| 2,661,809 | 12/1953 | Hewitt et al. | 55/138 |
| 2,672,947 | 3/1954 | Klemperer | 55/117 X |
| 2,701,622 | 2/1955 | Hodson | 55/120 |
| 2,789,657 | 4/1957 | Fields | 55/137 |
| 2,798,572 | 7/1957 | Fields | 55/137 |
| 2,869,678 | 1/1959 | Roberts | 55/138 |
| 2,911,060 | 11/1959 | Rawe | 55/117 |
| 2,948,353 | 8/1960 | Penney | 55/145 X |
| 3,040,498 | 6/1962 | Berly | 55/138 |
| 3,495,381 | 2/1970 | Flanagan | 55/138 X |
| 3,740,926 | 6/1973 | Duval | 55/138 X |
| 4,231,766 | 11/1980 | Spurgin | 55/138 |

FOREIGN PATENT DOCUMENTS

| | | | |
|---|---|---|---|
| 464192 | 4/1937 | United Kingdom | 55/138 |

*Primary Examiner*—Bernard Nozick

[57] ABSTRACT

An improved method for energizing the high voltage plates in a gas-cleaning device is provided using a corona discharge. Also, an improved device for cleaning the particles from the precipitator plates using high velocity air is provided such that the cleaning can occur without the normal operation of the precipitator. These improvements are particularly useful in two-stage gas-cleaning electrostatic precipitator having a close-spaced collecting stage wherein the electrically isolated high voltage and electrically connected low voltage plates are spaced very close together, typically about 0.0625 inches apart.

10 Claims, 7 Drawing Sheets

CLOSE-SPACED ELECTROSTATIC PRECIPITATOR

This is a continuation of co-pending application Ser. No. 735,566, filed on May 17, 1985, now abandoned.

BACKGROUND OF THE INVENTION

1. Field of the Invention

This invention relates to any two-stage gas-cleaning electrostatic precipitator for removing particles from a gas. More particularly, it relates to an improved collecting means for precipitating ionized particles.

A two-stage gas-cleaning electrostatic precipitator usually consists of an ionizing stage, a collecting stage and a means for causing gas needing to be cleaned first to pass through the ionizing stage and then through the collecting stage. The particles to be removed from the gas are ionized or given a charge when the gas passes through the ionizing stage. The charged particles pass into the collecting stage where they are precipitated. The precipitation occurs because there is a voltage gradient in the spaces between the plates of the collecting stage which acts on the charged particles, moving them to the plates and thus out of the gas stream.

2. Description of the Prior Art

The Cottrell-type electrostatic precipitator has been used since about 1905 to remove particles from smoke stack gases. In a Cottrell-type electrostatic precipitator the particles are both charged and precipitated in the same corona region. As a result, this type of electrostatic precipitator ("ESP") is called a single-stage ESP. A single-stage ESP, however, has several drawbacks. It cannot be used for cleaning ventilating air because it generates excessive ozone. Also a single-stage ESP is usually large and requires a high voltage, typically 40 KV to 100 KV.

My U.S. Pat. No. 2,129,783, issued July 26, 1938, describes a much more compact and lower voltage ESP. This ESP only uses corona to charge the particles which are then removed in a corona-free region whereas the Cottrell-type precipitator uses corona both to charge and precipitate the particles. As a result, this type of ESP is called a two-stage ESP. Only a very small amount of ozone is generated in a two-stage ESP and therefore it can be used for cleaning ventilating air. In the two-stage ESP described in the above patent, the plates of the particle collecting section are spaced about 0.25 inches apart. This compares to a spacing of 4.0 inches between high and low voltage electrodes in the Cottrell-type ESP.

To a first approximation, a given cleaning capacity measured in cubic feet per minute (CFM.) requires a given particle or dust collecting area. Reducing the spacing between electrodes reduces the size of the ESP, but it also reduces the dust holding capacity. Consequently, a two-stage ESP, typically, has been used only for relatively low particle loadings except for the case of oil droplets where the collected liquid can continuously drain from the collecting electrodes. Thus, there is a need for a two-stage ESP capable of handling high particle loadings.

Typically, two-stage precipitators are operated with a gas velocity at the face of the collecting section of 300 ft./min. to 400 ft./min. At this gas velocity and with high particle loadings the collecting section will require frequent cleaning. Normally this is done by shutting down the precipitator and removing the collecting section for cleaning with water. A preferable cleaning mechanism would be one which can function effectively during the operation of the precipitator without shutting it down.

Two-stage precipitators can also cause a space charge problem in rooms supplied with imperfectly cleaned air. This problem is described in the paper entitled "Electrically Charged Dust in Rooms" by Gaylord W. Penney and George W. Hewitt, *Trans. of Amer. Inst. of Electrical Engrs.*, 1949. Space charge can be summarized as follows: (1) all of the particles to be precipated are given a charge of one sign by passing them through a corona discharge; (2) if these charged particles are not removed by the collecting stage, a space charge is created in the room supplied by this partially cleaned air; (3) this space charge drives any other charged particles toward the room's walls making them very dirty.

My U.S. Pat. No. 2,948,353, issued Aug. 6, 1960, described a two-stage ESP with much closer spacing between the high and low voltage electrodes (between 0.02 inches and 0.08 inches). At this close spacing, it is expected that short circuits between electrodes will occur frequently and so the precipitator is designed to operate with some electrodes short circuited. This is accomplished by two different methods. In the first method a number of electrodes are operated in series using semi-conducting spacers and a current limiting series resistance. In the second method insulating spacers are used between the electrodes with every other electrode connected together and grounded. The alternate or high voltage electrodes located between the connected and grounded electrodes are each connected to a high voltage power source through a current limiting series resistance.

The 2,948,353 patent, however, has not been used commercially because suitable high resistance, low cost materials, with the required uniformity of resistance, have not been available for use as either the spacers or the current limiting series resistance. Also, even if suitable resistance materials were available, the particle holding capacity of the invention described by the 2,948,353 patent is very limited.

SUMMARY OF THE INVENTION

The present invention provides an improved means for energizing isolated high voltage plates and also provides a means for removing collected particles from a precipitator by means of a relatively small stream of high velocity gas. These improvements can be used in any gas-cleaning device including a two-stage precipitator.

Further, the present invention uses an assembly of close-spaced electrode plates separated by insulating strips such that they create a plurality of channels in the direction of gas flow having a substantially constant cross-sectional area.

The term "plates" refers to any thin, extensive-surface electrodes having sufficient conductivity to maintain the desired voltage gradient across the plurality of channels to precipitate the particles, said "plates" being either flat, cylindrical, or spiral, or of any other shape which permits the maintenance of a reasonably uniform spacing between adjacent "plates".

Corona is a limited current discharge in which ions transport electric charge from an emitter having a small radius of curvature to a passive electrode having a large radius of curvature. The corona producing member or emitter is usually, but not necessarily, at high potential and the passive electrode is usually, but not necessarily, at ground. The potential in this corona discharge varies continuously from the passive electrode to the emitter. If an electrode is inserted into this discharge, it tends to take a potential corresponding to its position in the discharge. The current flowing to this electrode is only that carried by arriving ions, typically a few microamperes. Thus, corona can be used as a high impedance source to supply a potential to a field producing member or electrode.

In the present invention, corona is used as the improved means for energizing alternating electrically isolated high voltage plates. Each high voltage plate is electrically isolated from every other plate, and each electrically isolated plate is connected to an energizing means through a very high impedance. Although primarily discussed in the context of energizing closely-spaced plates, it is evident that corona can serve as a high impedance to energize any plate or surface which produces an electric field used to drive charged particles toward a collecting surface.

The use of corona as a high impedance to energize a field producing electrode or member limits the short circuit current to a few microamperes. To avoid spark-over problems, the potential supplied to the electrode usually should not exceed one-half of the total corona voltage where the total corona voltage is the voltage between the emitter and the passive electrode. If a spark occurs, however, the energy is on the order of a fraction of a millijoule, and causes very little audible noise.

In the close-spaced collecting means, if a spark occurs over the surface of an insulating means the heat generated by the spark is so small that the surface of the insulating means is not damaged. Additionally, a short circuit between any electrically isolated plate and any electrically connected plate does not interfere with the operation of the rest of the precipitator because there are many high voltage plates and each one is individually connected to an energizing means.

The invention also provides an improved means for cleaning particles from the precipitator plates of any two-stage precipitator while the precipitator is operating. A cleaning device utilizing high velocity air or gas and having at least one moveable member which moves over the face of the collecting means is provided. This improved means for cleaning can be used in a typical two-stage precipitator or in a precipitator with closely-spaced electrode plates.

In a precipitator with closely-spaced electrode plates, a vacuum cleaning device utilizing high velocity air or gas is preferred. The vacuum cleaning device has a moveable member which moves over the face of the collecting means through which the high velocity air is drawn while the precipitator is operating. The air is then drawn through a connecting means to a filtering means and then to an air moving means before being discharged into the outlet air. If a lower efficiency filtering means is used, then the imperfectly cleaned air can be discharged into the gas stream ahead of the ESP.

In a precipitator with standard 0.25 inch spacing and no insulating spacers between the electrode plates, a jet of high velocity air is blown through the plates from a moveable member positioned over the face of the collecting means. Typically, the jet of high velocity air is wide compared to the spacing between the plates. The ESP either can be shut down during cleaning or a second moveable member synchronized with the movement of the first moveable member can be provided which moves over the opposite face of the collecting means to remove the particle laden air of the high velocity jet and convey it to a filtering means for removal while the precipitator is operating. The second moveable member takes in more air than is discharged from the high velocity jet because some mixing of the high velocity jet with the surrounding air occurs.

The present invention also provides a means for detecting excessive short circuits which can cause space charge problems. In a preferred embodiment the electrically isolated plates are energized by a corona source located quite close to these plates. This energizing corona is operated, however, at a lower voltage than the corona source in the ionizing means so that there is almost no corona current to the electrically connected plates. Any current to the electrically connected plates is due to short circuits and leakage across the insulating means. Thus, the current to the electrically connected plates can be used to monitor the condition of the collecting means. A current detecting means such as a relay can be used to give an alarm or shut the precipitator down in case of a serious decrease in precipitator plate voltage caused by current flow between the electrically isolated plates and the electrically connected plates.

The electrically isolated plates can also be energized by the corona source in the ionizing means by adjusting the distance between the corona source and the electrically isolated plates to give the desired plate voltage. In this situation it is not usually feasible to make the normal current flow to the electrically connected plates negligible. If it is necessary to monitor the condition of the collecting means in this situation, the present invention can do so by isolating the collecting means and the high voltage portion of the energizing means from ground and monitoring the current to ground from this isolated assembly. This current is equal to the current being carried away by charged particles escaping from the collecting means. An increase in this current indicates that the electrically isolated plate voltage is so low that all of the charged particles are not being collected.

BRIEF DESCRIPTION OF THE DRAWINGS

For a better understandings of the invention, reference may be had to the preferred embodiment exemplary of the invention shown in the accompanying drawings, in which.

DESCRIPTION OF THE PREFERRED EMBODIMENT

Figure 1:
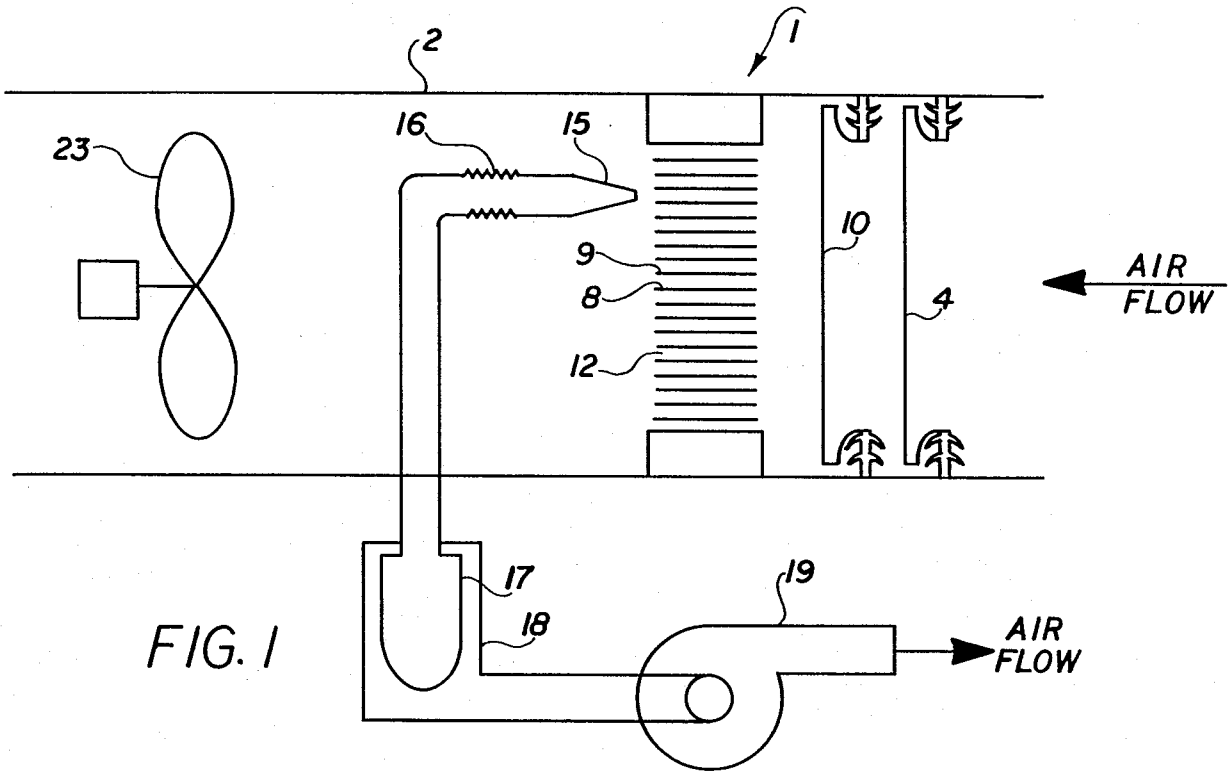
FIG. 1 generally shows a preferred embodiment of the invention described in this application.

A preferred embodiment is shown generally in FIG. 1. The precipitator 1 is enclosed in a housing 2. A fan 23 draws air or gas into the precipitator past the ionizing or corona wire 4 where particles or dust carried by the gas receive an electric charge. The charged particles are then carried between oppositely charged closely-spaced plates 8 and 9 where the electrical field drives the charged particles to the collecting plate 9 which is usually grounded. As shown, the high voltage plates 8 receive a charge or potential from a corona wire 10.

The energizing of the high voltage plates 8 by corona is not limited in any manner by the spacing between plates 8 and 9 of the collecting cell. For instance, corona can be used to charge the high voltage plates of the typical two-stage precipitator described in U.S. Pat. No. 2,129,783 if the high voltage plates extend beyond the grounded plates. In fact, corona can serve as the high impedance to energize any plate or surface which produces an electric field used to drive charged particles toward a collecting surface.

To periodically remove the collected particles a moveable member such as vacuum cleaning nozzle 15 draws air at a high velocity over a small section of precipitator plates 8 and 9. The insulating spacers between adjacent plates 8 and 9 form small channels of substantially constant cross-sectional area. Only a small volume rate of gas flow through the channels is needed to clean them. If plates 8 and 9 are spaced 0.0625 inches apart and nozzle 15 has a cross-sectional area of 0.002 $ft^2$, the volume rate of gas flow through the nozzle will be 32 CFM if the gas velocity through the nozzle is 16,000 ft/min.

This cleaning does not interfere with the normal operation of the precipitator because the gas flow required to effectively clean each of the hundreds of small channels is small compared to the main stream of gas being cleaned. By using a high gas velocity for cleaning, the time required to clean one channel is relatively short. As a typical example, a velocity of 16,000 ft/min and a cleaning time of 0.1 sec. gave good cleaning results. In a preferred embodiment, the moveable member moves continuously over the outlet face of the collecting means during normal operation of the precipitator cleaning approximately one channel at a time.

The high velocity air removes the collected particles from the precipitator plates and carries them through flexible duct 16 and into particle collecting bag 17 such as a disposable vacuum sweeper bag. The cleaned air passes through the bag into housing 18 and thence to vacuum cleaning fan 19. Alternatively, a filter, a single stage ESP or any other cleaning device can be used instead of collecting bag 17 for removing the dust from the cleaning means. The cleaned air passes through fan 19 and is discharged into the atmosphere. Alternatively, the cleaned air can be returned to the air flow ahead of the ESP.

Figure 2:
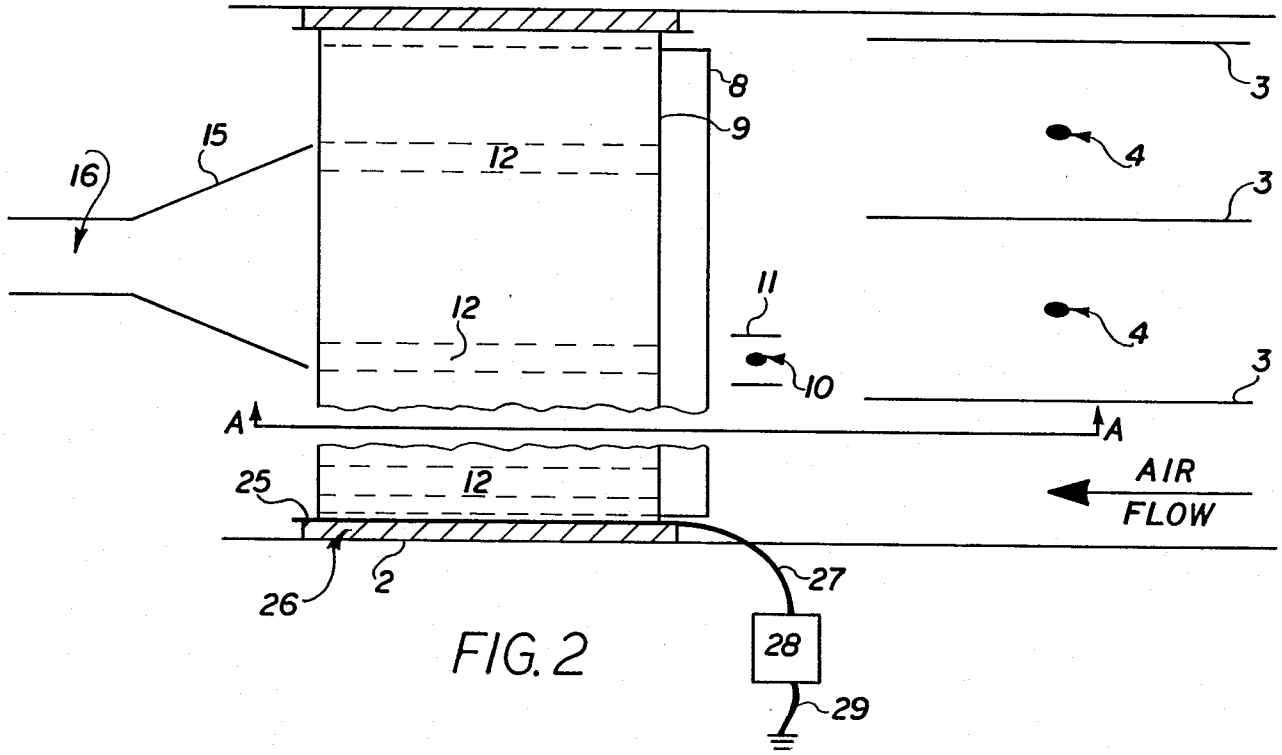
FIG. 2 shows a top view of a preferred arrangement of the close-spaced precipitator plates and the corona wires.

FIG. 2 shows a top view of the preferred arrangement of the close-spaced plates and the corona wires. Gas first passes through the ionizing means consisting of corona wires 4 and grounded plates 3 and then through the collecting means. In a preferred embodiment high voltage plates 8 protrude in the direction of corona wire 10 about 0.25 inches further than grounded plates 9. This is to facilitate the charging of the high voltage plates without drawing current to the grounded plates. Typically corona wire 10 is operated at a voltage of approximately 8 KV and is spaced 0.25 inches to 0.3125 inches from the protruding edge of high voltage plates 8 in order to give the desired voltage on high voltage plates 8 within the range of 0.5 KV to 6.0 KV.

Figure 3:
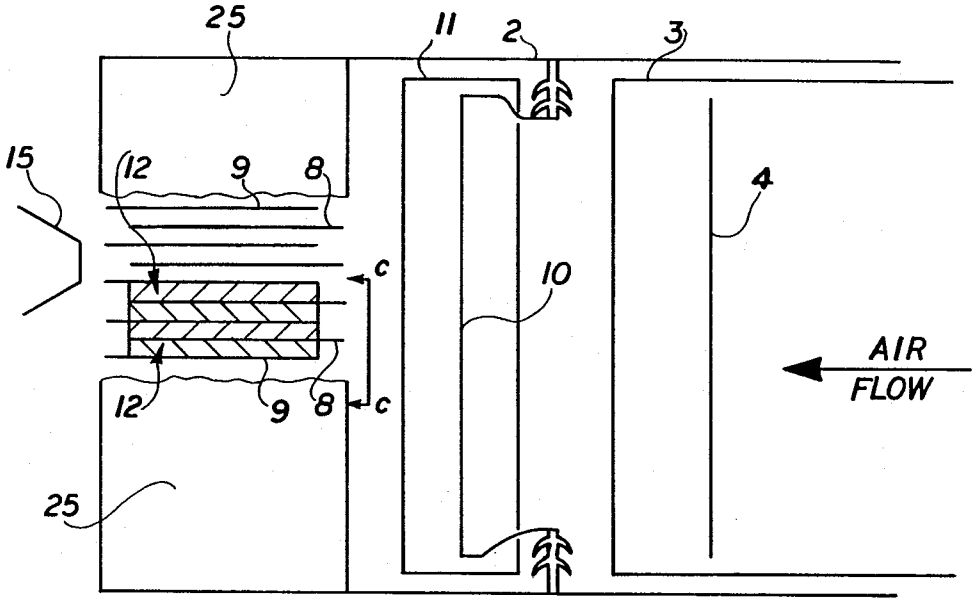
FIG. 3 shows a side view along line A—A of the preferred embodiment in FIG. 2.

Referring to FIG. 3, high voltage plates 8 and grounded plates 9 are spaced apart by insulators 12. Corona wire 10 is relatively close to high voltage plates 8 such that plates 8 are energized by ions from wire 10 and yet almost none of these ions reach grounded plates 9. Grounded plates 11 shield wire 10 from surrounding potentials and control the corona from wire 10. Grounded plates 3 are the conventional grounded plates used with the particle charging corona wires 4 in the ionizing means.

Again, it is evident that the energizing of the plate 8 by corona is not limited by the spacing between plates 8 and 9. It is possible to use corona to energize any high voltage electrode or surface to produce an electric field which can then be used to drive charged particles to a collecting surface. For example, one manufacturer has a two-stage precipitator in which 36 high voltage plates are connected together and supported by insulators, and the ionizer for charging the particles has from 7 to 9 wires. By locating only one or two of these wires close to the high voltage plates, the plates can be charged to the proper potential and yet the short-circuit current can be sufficiently limited.

Figure 4:
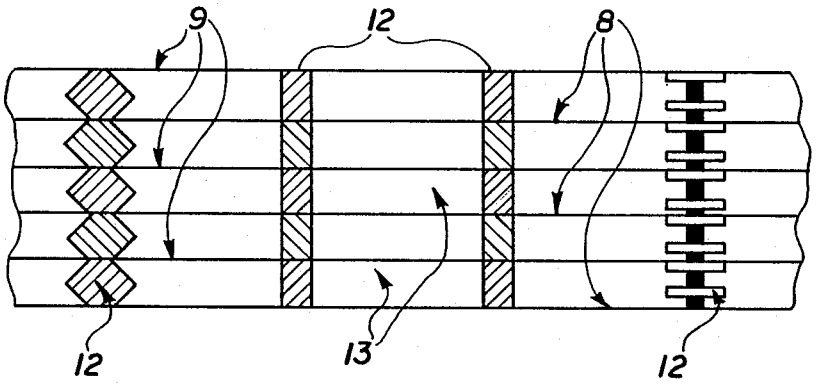
FIG. 4 shows close-ups of some typical insulating spacer means used in the invention as seen along line C—C of FIG. 3.

FIG. 4 shows a close-up of the close-spaced precipitator plates along line C—C of FIG. 3. This shows the relatively small channels 13 bounded by plates 8 and 9 and insulators 12. These channels form a confined path of substantially constant cross-sectional area through which a smaller high velocity air stream can be guided by nozzle 15 to effectively remove the collected particles. On the average, the close-spaced precipitator plates are spaced apart by a distance which falls within the range of 0.04 inches to 0.1875 inches. Several different shapes of insulators 12 are shown in FIG. 4 providing different creepage distances between the precipitator plates.

As shown in FIG. 2, grounded plates 9 are connected to end plate 25. Insulator 26 separates end plate 25 from the main housing 2. Any leakage current, including short circuits between plates 8 and 9 flows to end plate 25. For measuring this leakage current, lead 27 connects end plate 25 to meter 28 and lead 29 connects meter 28 to ground or to the main housing 2. The current measured by meter 28 indicates how well precipitator 1 is operating.

Figure 5:
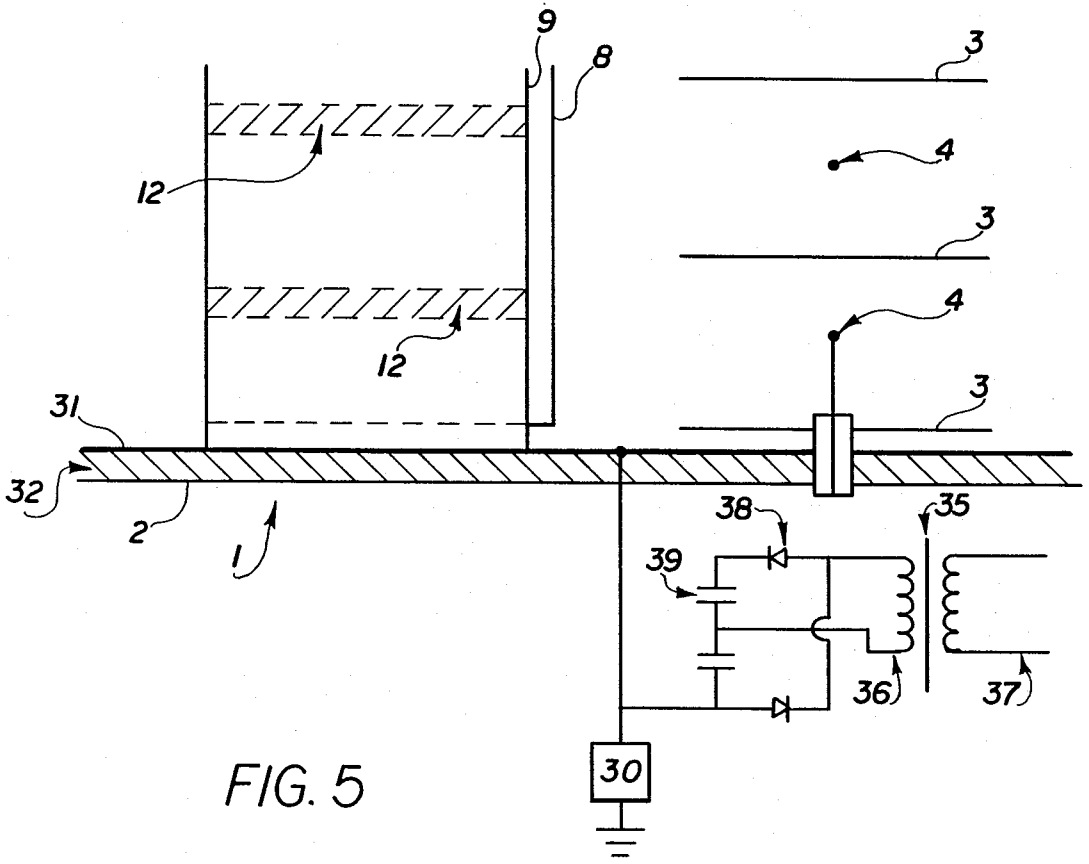
FIG. 5 shows an alternative method for energizing the electrically isolated plates.

An alternate method for energizing high voltage plates 8 is shown in FIG. 5. In this embodiment the ionizing means and the corona wires 4 are positioned closer to the high voltage plates 8 such that plates 8 are raised to the desired potential by corona from wires 4. In this case it may not be feasible to use dimensions such that the corona current to the grounded plates 9 will be negligible. In this case, the method for monitoring insulator leakage shown in FIG. 2 cannot be used.

FIG. 5 shows another embodiment for monitoring the operating condition of precipitator 1 in which the entire precipitator is isolated from ground so that charged particles carried away from the precipitator will cause a corresponding current from the precipitator to ground which can be monitored by a very sensitive meter 30. To isolate precipitator 1 from ground, it is surrounded by a conducting member 31. Member 31 is isolated from housing 2 by insulation 32. Further-more, there must be negligible leakage current between the high and low voltage circuits of the power supply, which may require an electrostatic shield 35 between secondary winding 36 and primary winding 37 of the power supply transformer. Also recitifiers 38 and capacitors 39 of the power supply must be mounted so as to minimize leakage current.

Figure 6:
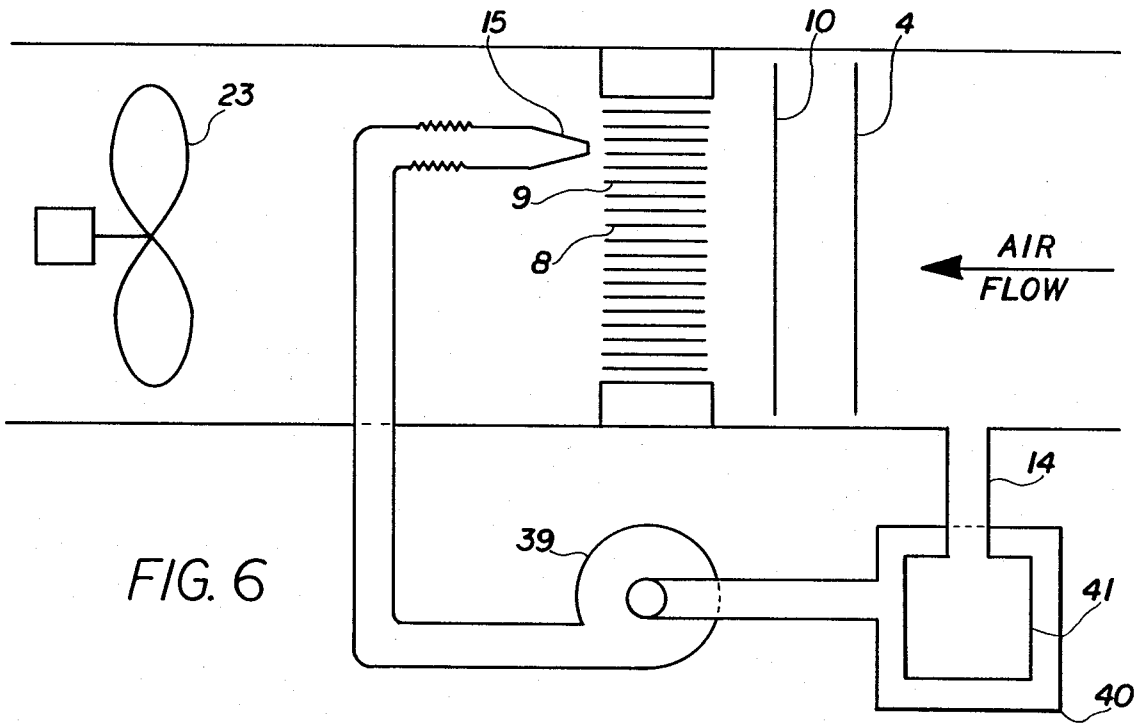
FIG. 6 shows the cleaning means arranged to blow air through the precipitator plates.

Experience indicates that particles and lint may collect on the leading edge of plates 8 and 9 in FIG. 1. Vacuum cleaning, even with high velocity air may be unable to remove all of these particular obstructions. Thus, it is desirable to provide the precipitator with the capability of blowing high velocity air through the plates, as shown in FIG. 6. To do this, fan 23 is stopped, shutting down the ESP. Fan 39 is used to blow air through flexible duct 16 and out of nozzle 15. The particle laden air is then drawn by fan 39 through duct 14 into housing 40. Collecting bag 41 collects the particles but allows the clean air to pass through to fan 39. If there are particles stuck to the plates which cannot be removed by using just high velocity air, small plastic pellets can be injected into the high velocity air to help remove any adherent materials stuck to the plates.

This method of cleaning by blowing is not limited to close-spaced precipitators. A sufficiently confined stream of cleaning air can also be obtained by blowing a high velocity jet of air through the 0.25 inch standard-spaced collecting plates having no separating spacers as long as the jet is wide as compared to the plate spacing. This width maintains a high velocity at the center of the air stream throughout the entire length of the collecting plate. A larger stream of cleaning gas is required in the standard-spaced cell than in the close-spaced cell but one nozzle can handle either ESP. A suitable nozzle 71 for the standard-spaced cell would be 6 inches by 0.375 to 0.5 inches. There will be some spreading of the high velocity jet so that some overlap of successive passes is desirable. For example, with a 6 inch nozzle width a 1 inch overlap on successive passes is desirable. Although a relatively wide nozzle is preferred, good cleaning results have been obtained with a nozzle only 0.2 inches by 0.5 inches and with a 0.5 inch overlap on successive passes.

A nozzle 15 for blowing gas through the plates is illustrated in FIG. 6. When blowing the high velocity cleaning air through the plates, the spacing between the nozzle and the outlet face of the collecting cell is not as critical as in the vacuum cleaning described previously in this application. Good operation has been achieved with blowing nozzle 15 spaced 0.5 inches from the outlet face of the collecting cell.

Figure 7:
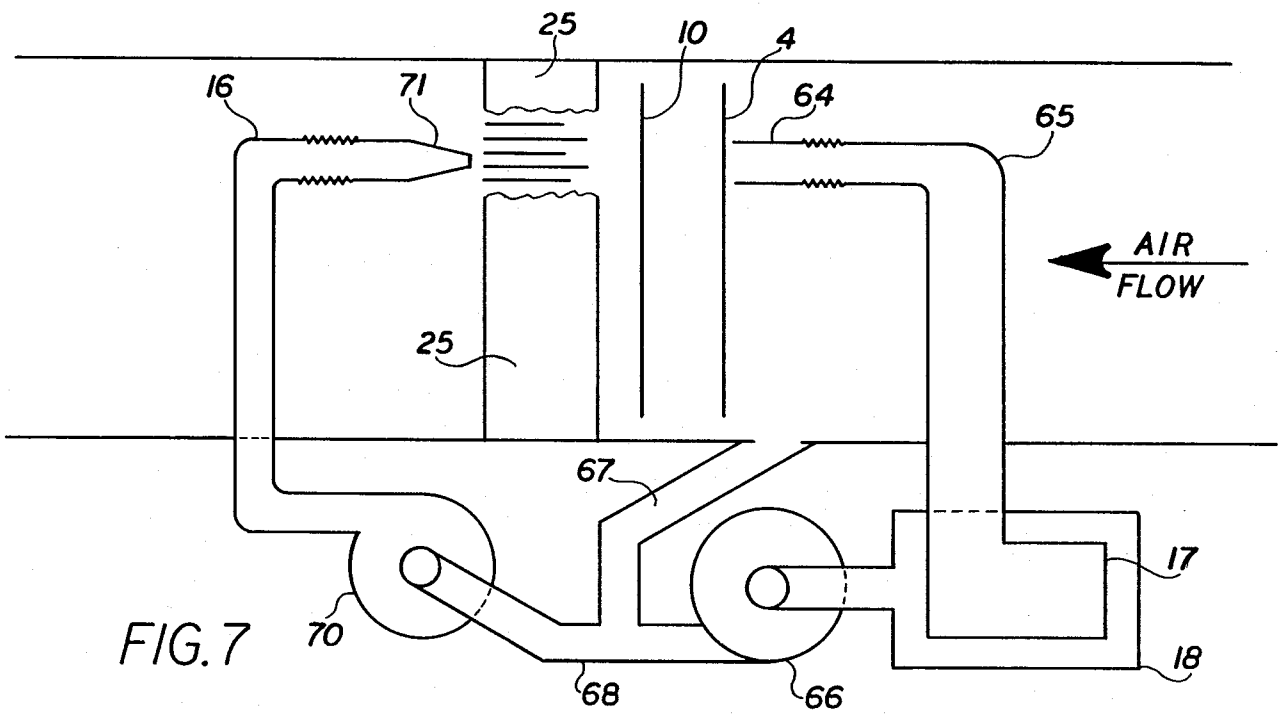
FIG. 7 shows the first moveable member of the cleaning means arranged to blow air through the precipitator plates and into the second moveable member.

As shown in FIG. 6, the ESP is intended to be shut down during this cleaning operation. An arrangement for cleaning while any ESP, either standard or close-spaced, is operating is shown in FIG. 7. This shows a second moveable member 64 positioned ahead of the collecting cell to collect the high velocity stream of gas dust from the first moveable member, nozzle 71. The movement of the second moveable member is synchronized with the movement of nozzle 71 over the face of the collecting cell.

Since there will be some mixing of the high velocity jet with the surrounding gas, this second moveable member 64 must collect a larger volume of gas than that issuing as the high velocity jet from nozzle 71. To achieve this, one fan 66 is used to draw the dust laden air collected by second moveable member 64 through connector 65 and pass it through a second gas cleaning device such as is shown and described in FIG. 1. A second fan 70 then draws a part of this cleaned gas through connector 68 and blows it through cleaning nozzle 71. The remaining cleaned gas is returned through connector 67 to the air flow ahead of the ESP.

In one preferred embodiment, similar to that shown in FIG. 2, the close-spaced collecting cell is 24"×30"×2" and can handle 3,000 CFM of air. The collecting cell is made from individual units which are 6"×6"×2". These units have alternating high voltage plates 8 and grounded plates 9 which are spaced 0.0625 inches apart by insulating strips 12 of plexiglass. The plexiglass strips and the plates form the small channels 13 of uniform cross-sectional area 13.

At least four corona energizing wires 10 (one for each row of units) are positioned approximately 0.25 inches from the protruding edge of the high voltage plates 8 of the individual units. These wires are operated at 8.0 KV to obtain a voltage gradient across the small channels between the high voltage plates and the grounded plates of 2.5 KV.

The ionizing means for charging the particles is placed approximately 4.0 inches in front of the protruding edge of the high voltage plates 8. It consists of ten ionizing wires 4, spaced 2.5 inches apart, and eleven grounded plates 3, spaced 2.5 inches apart, placed such that the wires are between the plates. The wires are operated at a voltage of 12.0 KV.

A prototype of the individual unit described above has been constructed and some preliminary tests performed. A standard-spaced precipitator has a face velocity at the collecting cell of 300 ft./min. to 400 ft./min. The prototype unit of the close-spaced cell was successfully operated at 600 ft./min. and it appears that 800 ft./min. to 1,000 ft./min. is possible. The close spacing of the plates reduces the Reynolds number for the precipitator and the corresponding reduction in turbulence makes higher face velocities feasible.

The prototype close-spaced cell was tested for its efficiency using welding smoke. The particulates in welding smoke are submicron in size. The precipitator was operated in the normal precipitating mode and then shut down for cleaning. A vacuum cleaning nozzle was then manually moved over the outlet face of the individual collecting unit.

The cleaning nozzle was slightly larger than one channel, and could be moved so that one channel was always being cleaned. The velocity of the cleaning air through the nozzle and channel was between 8,000 ft./min. and 16,000 ft./min. with the volumetric flow being between 25 CFM and 50 CFM. There does not appear to be any reason why a higher velocity could not be used. The precipitator was restarted after cleaning and this process was repeated several times.

The efficiency for the prototype unit as measured by both a filter discoloration test and a charge carrying ability test was at least 99%. This compares to the normal efficiency of a two-stage ESP in the ventilating field of 95%. With a 99% efficiency, the close-spaced precipitator can operate with several plates short circuited before its efficiency will be seriously impaired. The vacuum cleaning helps maintain the high efficiency by preventing a thick layer of particles from accumulating on the precipitator plates and causing reintrainment of particles.

While a presently preferred embodiment of the invention has been shown and described, it may be otherwise embodied within the scope of the appended claims.

What is claimed is:

1. A two-stage gas-cleaning precipitator comprising:

(a) an ionizing means for charging a plurality of particles;

(b) a means for causing a gas to pass first through the ionizing means and then through a collecting means, the collecting means comprising a plurality of parallel collecting electrodes, alternate electrodes at a reference potential and intermediate electrodes electrically isolated from each other and the alternate electrodes; and (c) a means for individually energizing each intermediate electrode with a similar corona, current comprising a corona source separate from the ionizing means having a plurality of parallel corona wires such that each wire is in close proximity to and equidistant from each intermediate electrode.

2. A two-stage gas-cleaning precipitator as described in claim 1 wherein the collecting electrodes are comprised of plates and the corona source supplies electric charge directly to each intermediate plate to create an electric field for precipitating the charged particles.

3. A two-stage gas-cleaning precipitator as described in claim 2 wherein the intermediate plates extend beyond the alternate plates on a side adjacent to the corona source.

4. A two-stage gas-cleaning precipitator as described in claim 2 further comprising a means for detecting current flow between the intermediate plates and the alternate plates.

5. A two-stage gas-cleaning precipitator as described in claim 2 wherein:

(a) the intermediate plates are sufficient in number such that short circuits do not appreciably reduce the efficiency of the precipitator.

6. A two-stage gas-cleaning precipitator as described in claim 2 wherein:

the alternate plates are connected to ground.

7. A two-stage gas-cleaning precipitator as described in claim 2 wherein the collecting means has:

a plurality of insulating spacer means for holding successive collecting plates in a close-spaced relationship, the spacer means being disposed at spaced intervals to form a plurality of parallel channels having a substantially constant cross-sectional area, the plurality of channels being sufficient in number that the gas flow through one channel is small compared to the gas flow through the close-spaced collecting means.

8. In a two-stage gas-cleaning precipitator having an ionizing means for charging a plurality of particles, a collecting means for precipitating the charged particles and a means for causing a gas to pass first through the ionizing means and then through the collecting means, the improvement comprising:

(a) the collecting means comprising a plurality of parallel collecting plates, alternate plates at a reference potential and intermediate plates electrically isolated from each other and said alternate plates; and (b) a means for individually energizing each intermediate plate with a similar corona current comprising a corona source separate from the ionizing means comprising a plurality of parallel wires in close proximity to said intermediate plates for supplying electric charge directly to each intermediate plate to create an electric field for precipitating the charged particles and wherein each wire is equidistant from and perpendicular to each intermediate plate.

9. In two-stage gas-cleaning precipitator as described in claim 8, the improvement further comprising the collecting means having a plurality of insulating spacer means for holding successive collecting plates in a close-spaced relationship, the spacer means being disposed at spaced intervals to form a plurality of parallel channels having a substantially constant cross-sectional area, the plurality of channels being sufficient in number that the gas flow through one channel is small compared to the gas flow through the close-spaced collecting means.

10. A two stage gas-cleaning precipitator comprising:

(a) an ionizing means for charging a plurality of particles;

(b) a means for causing a gas to pass first through the ionizing means and then through a collecting means, the collecting means comprising a plurality of parallel collecting electrodes, alternate electrodes at a reference potential and intermediate electrodes electrically isolated from each other and the alternate electrodes; and (c) a means for individually energizing each intermediate electrode with a similar corona current comprising a corona source having a plurality of parallel wires such that each wire is in close proximity to and equidistant from each intermediate electrode, and wherein the corona source and the ionizing means are the same and the corona source is perpendicular to the collecting electrodes.

* * * * *